US005667103A

United States Patent [19]

Donselman et al.

[11] Patent Number: 5,667,103

[45] Date of Patent: Sep. 16, 1997

[54] LIQUID DISPENSER WITH READILY REMOVABLE RESERVOIR AND ADAPTOR PERMITTING USE WITH VARIOUS DISPENSERS

[75] Inventors: Edward H. Donselman; Lowell C. Burnham, both of Freeport, Ill.

[73] Assignee: Elkay Manufacturing Company, Oak Brook, Ill.

[21] Appl. No.: 403,254

[22] Filed: Mar. 10, 1995

[51] Int. Cl.[6] ..... B67D 5/56

[52] U.S. Cl. ..... 222/129; 222/146.1; 62/394

[58] Field of Search ..... 222/129, 146.1, 222/146.6, 185.1; 62/390, 391, 394, 395

[56] References Cited

U.S. PATENT DOCUMENTS 4,629,096 12/1986 Schroer et al. .

4,958,747 9/1990 Sheets ..... 222/129 X 5,121,612 6/1992 Guay et al. ..... 62/390

OTHER PUBLICATIONS

*The New Shapes in Bottled Water Coolers . . . Complete With Removable Reservoirs*, Ebtech Corporation KJUF-800, Panel, Upper Front, Sheet 1 of 2 schematic (4 pages), Kel-Jac Engineering.

KJUF-800, Panel, Upper Front, Sheet 2 of 2 shematic (4 pages), Kel-Jac Engineering.

*Primary Examiner*—Gregory L. Huson

*Attorney, Agent, or Firm*—Niro, Scavone, Haller & Niro

[57] ABSTRACT

A liquid dispenser having a drop-in/lift-out reservoir that can be readily disassembled from or assembled to a housing, permitting easy cleaning of the reservoir, and not requiring the detachment of hoses or fittings. In another embodiment, alcove adaptors are provided that can be selectively used to permit various liquid dispenser configurations to be operably connected to the housing assembly.

11 Claims, 8 Drawing Sheets

FIG. 3
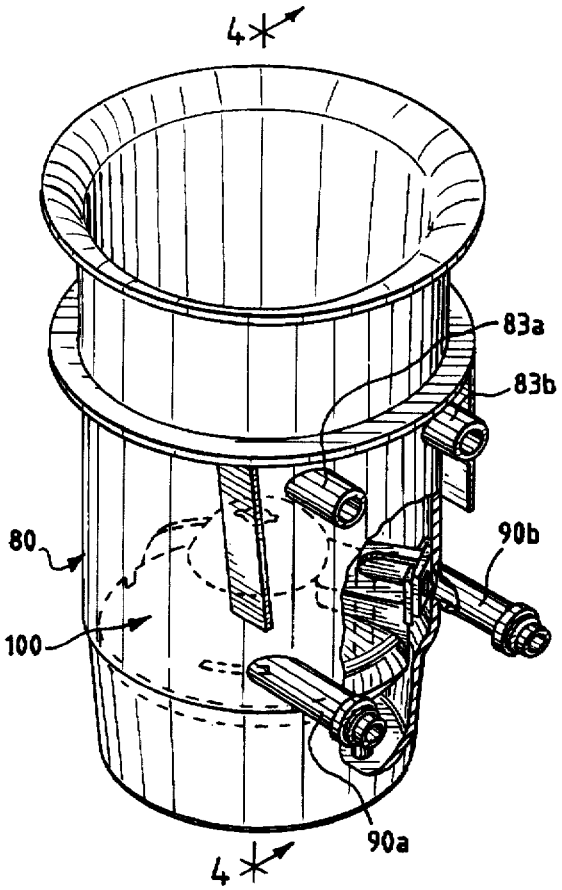
FIG. 5
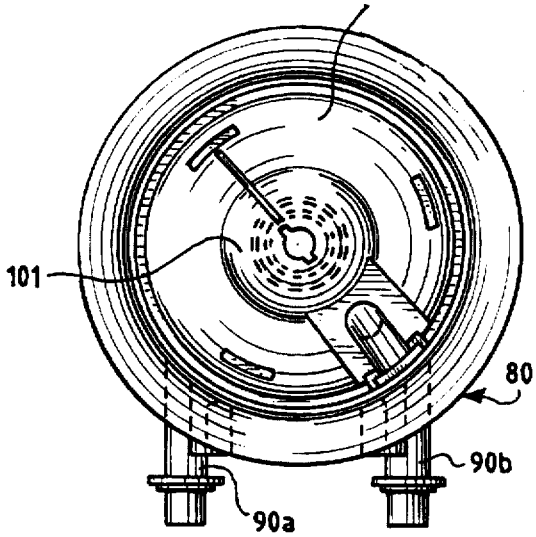
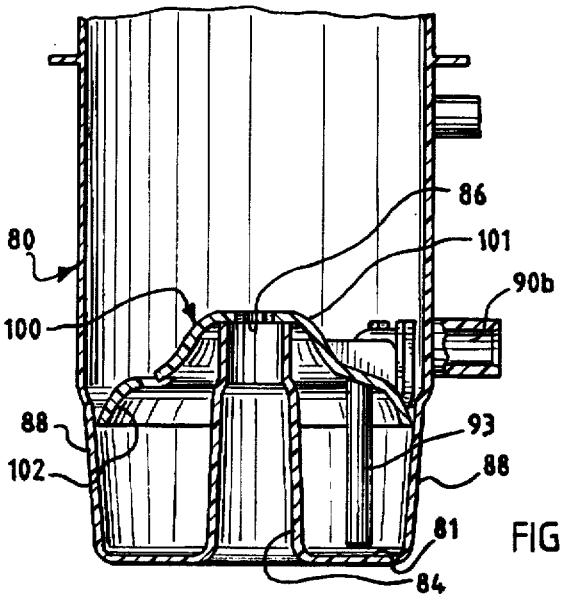
FIG. 4
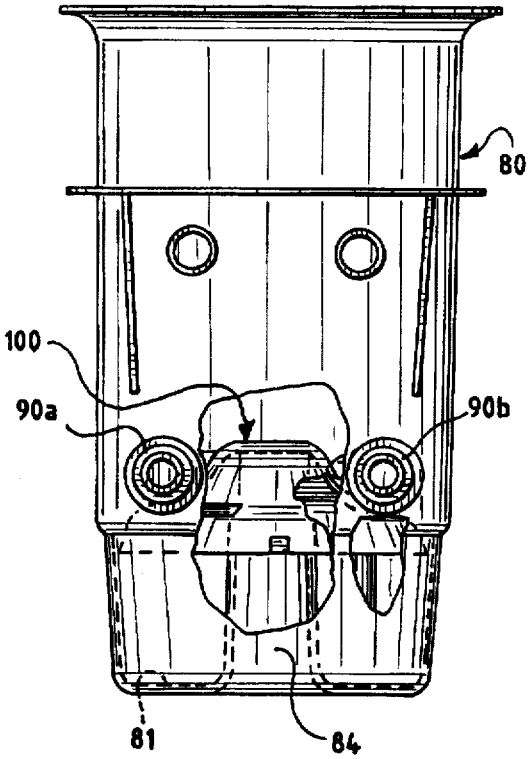
FIG. 6

FIG. 7
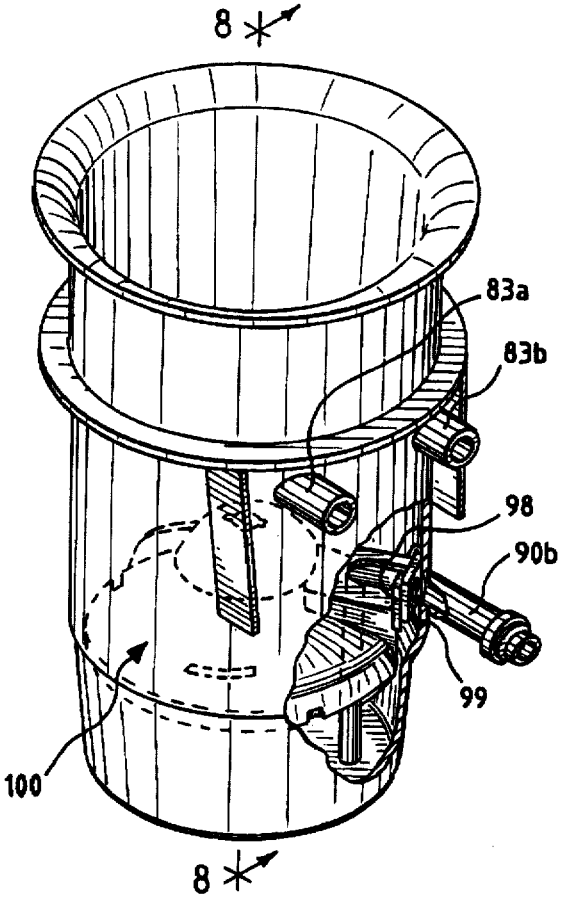
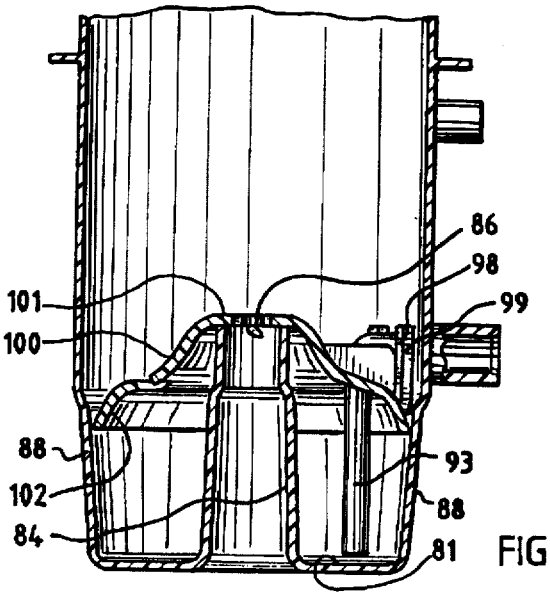
FIG. 8
FIG. 9
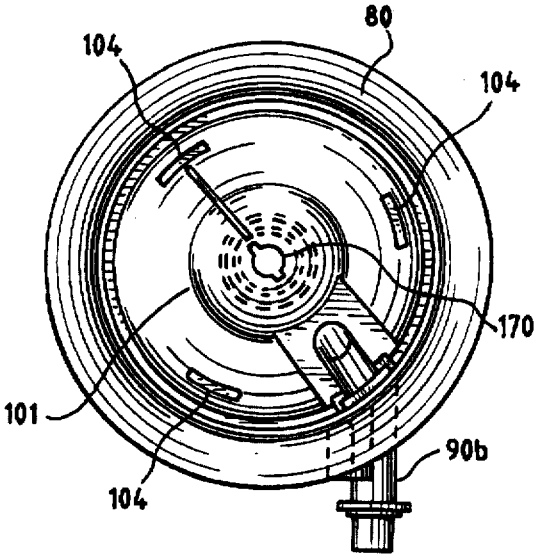
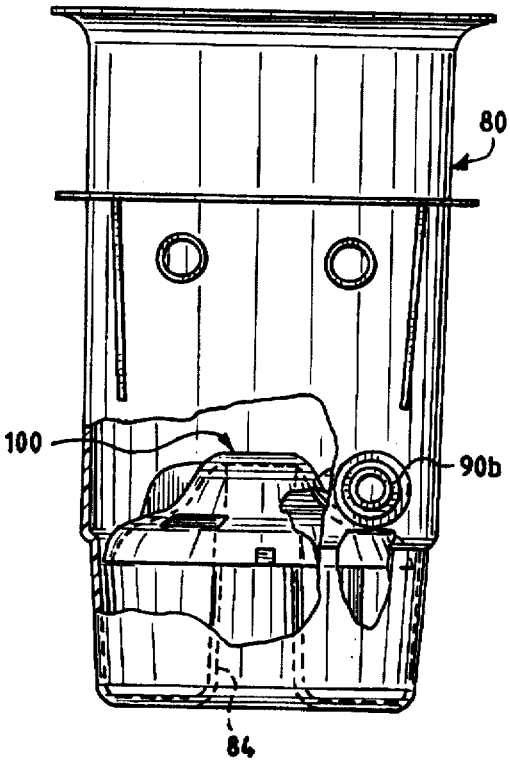
FIG. 10

FIG. 11
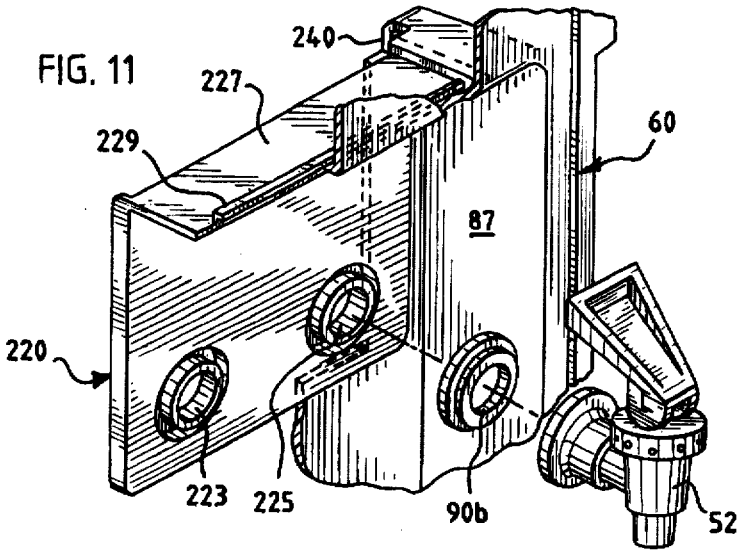
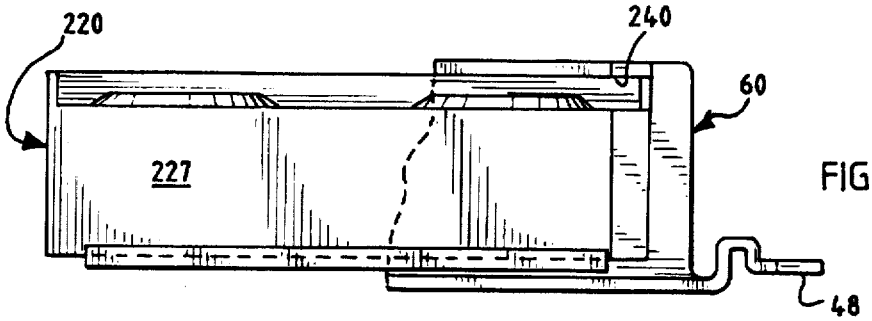
FIG. 12
FIG. 13
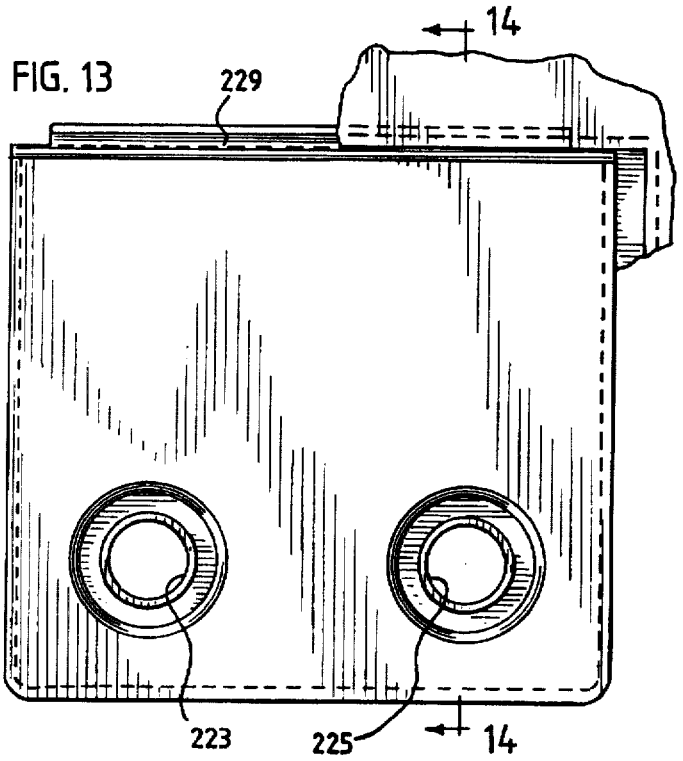
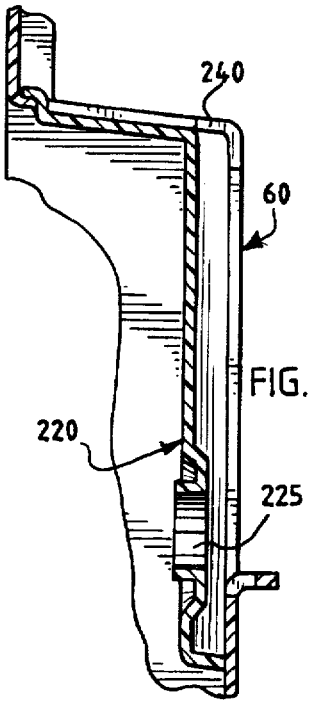
FIG. 14

FIG. 15
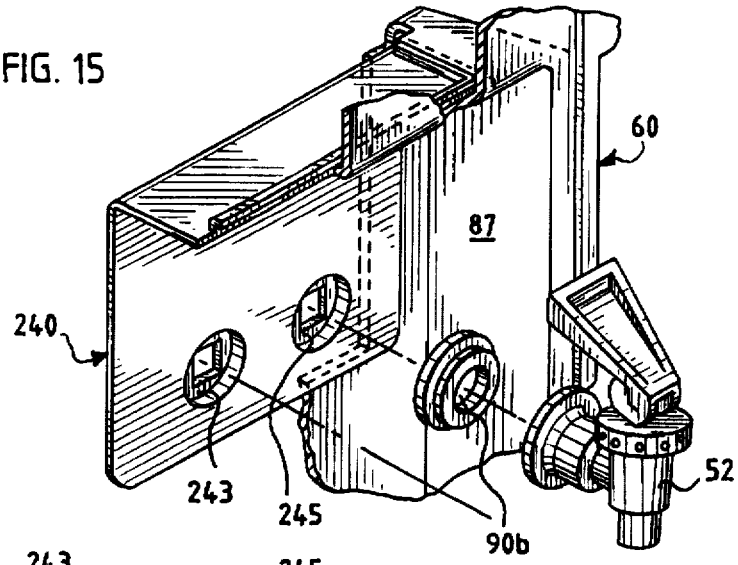
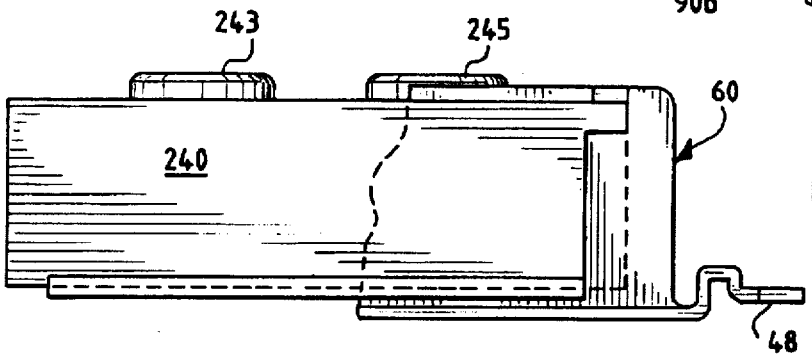
FIG. 16
FIG. 17
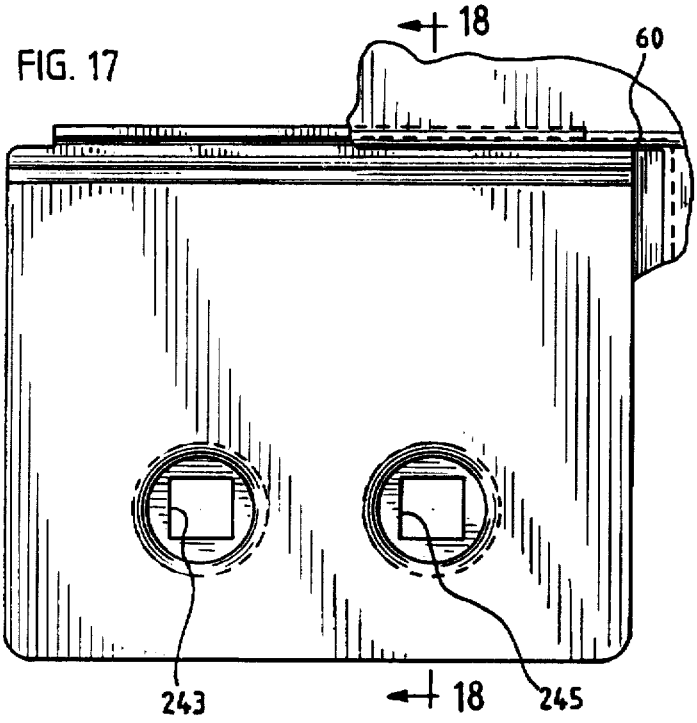
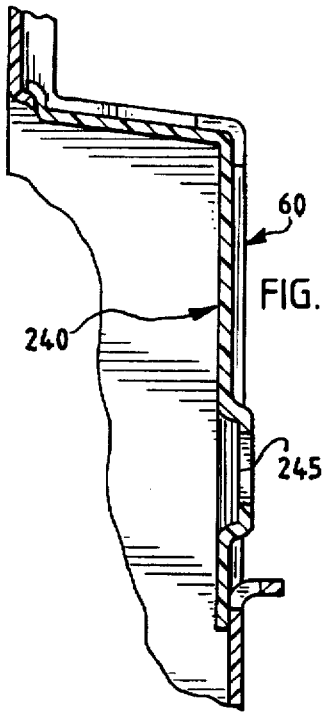
FIG. 18

LIQUID DISPENSER WITH READILY REMOVABLE RESERVOIR AND ADAPTOR PERMITTING USE WITH VARIOUS DISPENSERS

BACKGROUND OF THE INVENTION

The present invention relates generally to liquid dispensers, such as dispensers providing refrigerated or heated water. More particularly, the present invention is directed to liquid dispensers which can be quickly and easily disassembled, cleaned, and reassembled, or which can be reconfigured so that one housing may be used with dispensers made by different manufacturers.

Water coolers, such as those using bottled water, continue to remain popular. These bottle-type water coolers generally include an upright cabinet or housing containing a refrigeration unit and a reservoir which receives the mouth and neck portion of an inverted water bottle. If hot water is also dispensed, the housing can also contain a water heater.

Many water coolers or beverage dispensers continue to suffer from problems associated with sterility and cleanliness, two important issues with potable liquids. Such problems can result from the materials from which the reservoir, faucet or associated piping is formed. Thus, oxidation or general deterioration of metal components, due particularly to rust formation, can reduce the useful life of the liquid dispenser. Also, depending on the location or environment of the dispenser, and the type of water (hard or soft, for example) or other beverage used in the dispenser, the rate of dispensation, and the care taken to prevent the introduction of foreign matter when a bottle is replaced, particulates and other contaminants can be introduced into the reservoir, and can ultimately be dispensed through normal operation. Therefore, to enhance cleanliness, the reservoir of conventional bottle-type water coolers is most preferably cleaned periodically to remove sediment or other contaminants.

Periodic cleaning can be difficult if, as with many units, the reservoir is relatively inaccessible and requires substantial time to disassemble and reassemble to its housing. This problem is exacerbated where disassembly requires the detachment of faucets, hoses or fittings, or requires special expertise or tools. With some designs, the destruction of components during reservoir removal or reassembly, such as seals, is also possible or even likely. Many reservoirs are not designed to be removable from the housing, and cleaning all of the internal surfaces of such reservoirs can be difficult and time-consuming, if even possible. Ultimately, the removal procedures and attendant difficulties with prior art designs are believed to discourage the periodic maintenance considered beneficial for most satisfactory use of such water or beverage dispensing systems.

There also exists a need for a water cooler or beverage dispenser having an external housing sufficiently flexible in design so that it can be used with dispensers of different manufacturers. Currently, reservoirs of different manufacturers are of different sizes, and have different fittings, and cannot be readily assembled with housings made by different manufacturers. Yet the housings often require repair or replacement, particularly when they are located in places that have frequent access, and can be kicked, knocked over, or otherwise abused. When replacement is necessary, or the owner desires to replace an old or obsolete housing, it would be desirable to permit the selective replacement of the housing or any of its subcomponents instead of having to replace the dispensing assembly and related internal components. The present invention addresses this problem, as well.

SUMMARY OF THE INVENTION

The present invention preserves the advantages of prior art water coolers and beverage dispensers. In addition, it provides new advantages not found in currently available liquid dispensers of this kind, and overcomes many of the disadvantages of currently available dispensers.

The invention is generally directed to a liquid dispensing apparatus in fluid communication with a liquid container. A housing assembly typically supports the liquid container. The housing assembly includes a generally vertical wall with a recessed portion forming an alcove having an opening. A reservoir is operably connected to the alcove and is in fluid communication with the liquid container and with one or more liquid dispensing elements such as faucets. The reservoir includes a bottom surface and a raised bottom portion terminating in a port. The reservoir, upon removal of the liquid container, is vertically removable from the housing, and adapted to be readily dropped into or lifted out of the housing assembly. The liquid dispensing element is positioned outside the reservoir and is located so as to project through the alcove opening, thereby being accessible to a user of the liquid container. A baffle located within the reservoir and separating the reservoir into lower and upper regions containing liquid. The baffle serves to minimize the heat transfer effects between the liquid within the lower region and the liquid within the upper region. A cooling element operable to cool the liquid within the lower region of the reservoir is also used. The bottom surface of the reservoir rests on and is in heat exchange relation with the cooling element. The port on the raised bottom portion of the reservoir is positioned above both the baffle and the one or more liquid dispensing elements.

In one preferred embodiment, the "hot and cold" embodiment, a heater can be located below the reservoir, and receives liquid from the upper region of the reservoir through a vertically extending conduit. The liquid is heated in the heater, and the heated liquid is returned directly from the heater to a hot water faucet through a second conduit or hose. The "cold" faucet communicates directly with a lower region of the reservoir.

In another preferred embodiment, the "cook and cold" embodiment, a heater need not be provided. With this embodiment, the "cold" faucet communicates directly with a lower region of the reservoir, just as with the "hot and cold" embodiment. However, the "cook" faucet communicates directly with an upper region of the reservoir.

In another preferred embodiment, the lower surface of the reservoir is conically tapered, serving to facilitate the mating and direct engagement of the lower reservoir surface with an open, truncated conical cooling pan.

In still another preferred embodiment, the opening within the vertical wall of the housing is recessed. This recessed opening or "alcove" permits the assembly of an adaptor, which can be sized and configured to connect with reservoirs and faucets of various manufacturers. The adaptor also preferably substantially covers the side opening in the vertical wall, and communicates with the liquid dispensing elements to facilitate the proper positioning of the adaptor and the dispensing elements.

BRIEF DESCRIPTION OF THE DRAWINGS

These and other features, objects, and advantages of the present invention will become apparent from the following description of the drawings wherein like reference numerals represent like elements in the several views, and in which:

FIG. 3 is a perspective view, partially in section, of the reservoir assembly of the "cook and cold" embodiment;

FIG. 4 is a sectional view of the reservoir taken along line 4—4 of FIG.3;

FIG. 5 is a top view but showing the reservoir shown in FIG. 3;

FIG. 6 is a side view of the reservoir shown in FIG. 3;

FIG. 7 is a view similar to FIG. 3 of the reservoir assembly of the "hot and cold" embodiment;

FIG. 8 is a sectional view of the reservoir assembly, taken along the line 8—8 of FIG. 7;

FIG. 9 is a top view of the reservoir assembly of FIG. 7;

FIG. 10 is a side view of the reservoir shown in FIG. 7;

FIG. 11 is a perspective view showing the positioning of a faucet relative to portions of an alcove adaptor and the external housing;

FIG. 12 is a top view of the components illustrated in FIG. 11;

FIG. 13 is a front view, partially in section, of an alcove adaptor in interacting connection with a portion of the external housing;

FIG. 14 is a sectional view along line 14—14 of FIG. 13;

FIG. 15 is a view similar to FIG. 11 illustrating another alcove adapter;

FIG. 16 is a top view of the components illustrated in FIG. 15;

FIG. 17 is a front view illustrating another alcove adaptor;

FIG. 18 is a sectional view along line 18—18 of FIG. 17;

DETAILED DESCRIPTION OF THE PREFERRED EMBODIMENTS

Figure 1:
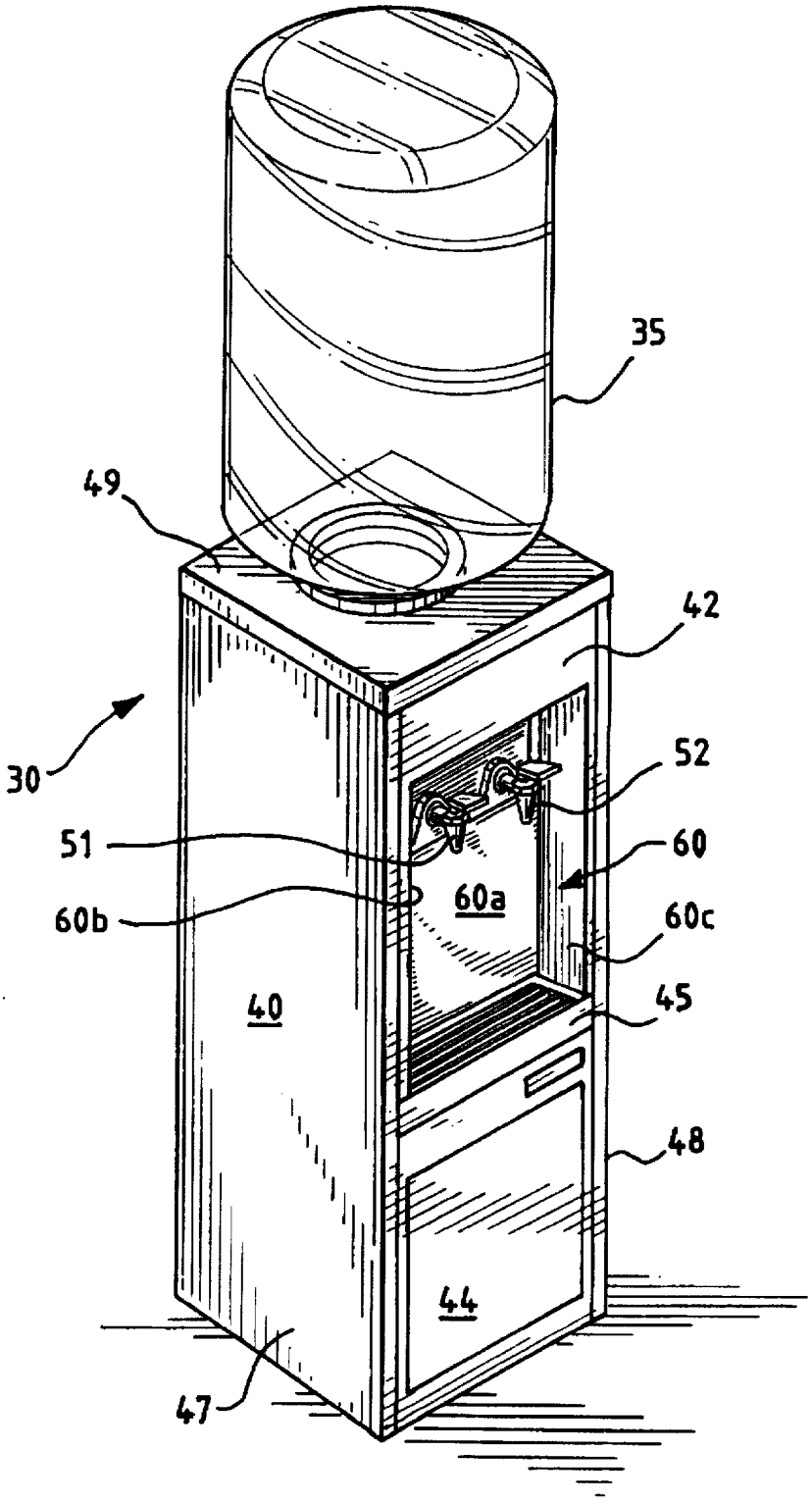
FIG. 1 is a perspective view of the liquid dispenser and housing of the present invention, as used with an inverted water bottle or carboy.

A liquid dispenser adapted for the dispensing of various liquids, such as water, is illustrated and designated generally as 30 in FIG. 1. Liquid dispenser 30 is typically portable and, in the specific embodiment disclosed here, is operable in connection with an inverted water bottle or liquid container 35. An external housing, designated generally as 40, provides support for liquid container 35 and also encloses the liquid dispenser internal components.

Referring to FIG. 1, external housing 40 includes a housing cover or top 49, a top front wall portion 42, a lower front wall portion 44, side walls 47 and 48, and alcove housing 60. The extending edges of top and lower front wall portions 42 and 44 and sidewalls 47 and 48 form a space into which alcove housing 60 can be inserted. Alcove housing 60 includes alcove wall 60*a* and alcove sidewalls 60*b* and 60*c*, and a drain receptacle 45 rests on a bottom wall of alcove housing 60, not shown.

While liquid dispenser 30 could be utilized without any cooling or heating apparatus, commercial units typically include at least a cooling unit or both heating and cooling units. When two faucets are used, one dispensing cold water and another dispensing room temperature water, this is known as a "cook and cold" unit; if one faucet dispenses cold water and the other dispenses hot water, this is known as a "hot and cold" unit.

Figure 2:
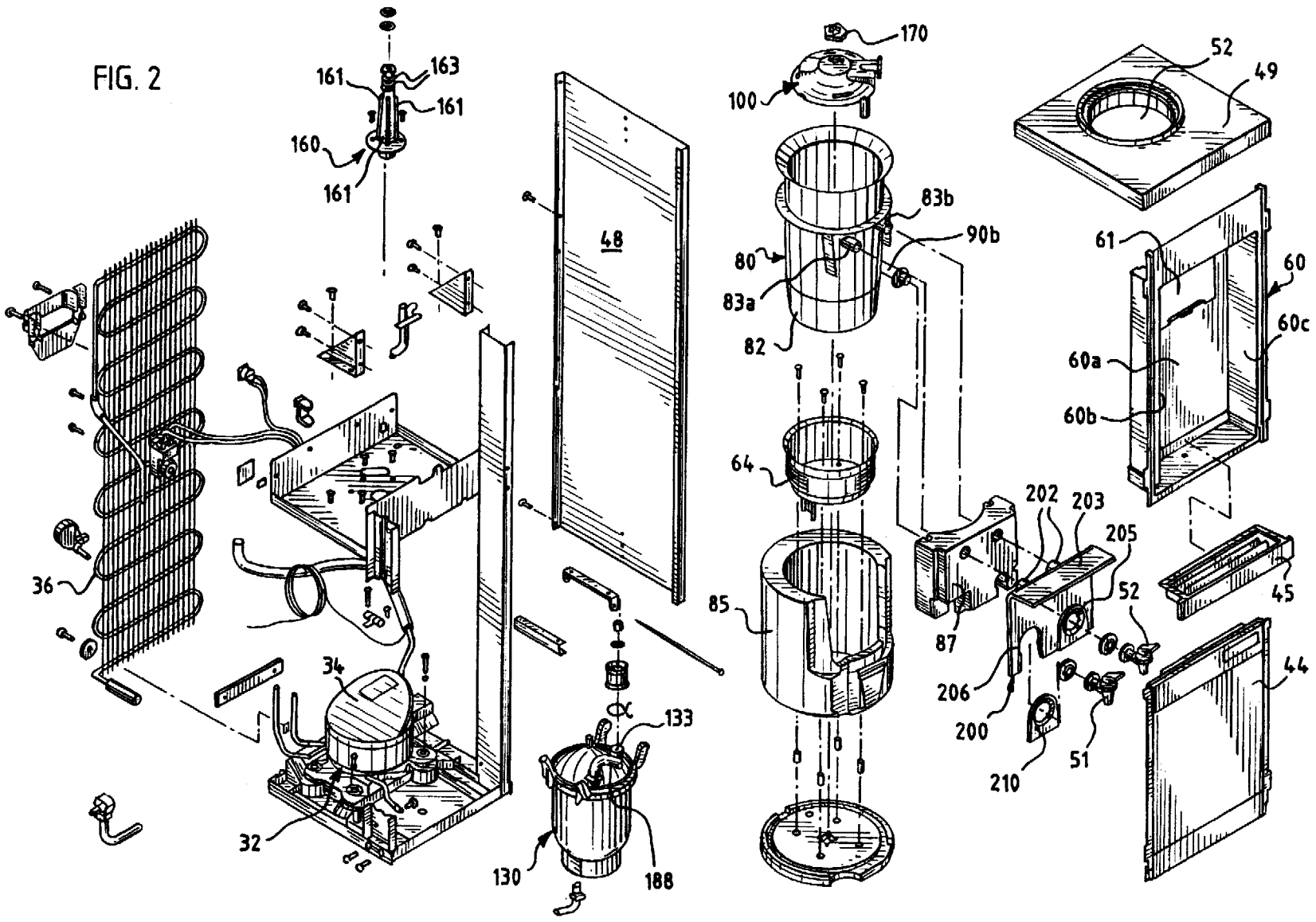
FIG. 2 is an exploded view of various components of the liquid dispenser of the present invention.

Turning now to FIG. 2, a cooling or refrigeration apparatus, designated generally as 32, includes conventional components such as compressor 34, a condenser, a capillary tube, and a cooling pan 64 together with associated evaporator coils. A thermostat, relay and electrical coils are preferably located within a lower portion of housing 40.

Still referring to FIG. 2, a reservoir 80 is adapted for receiving liquid from liquid container 35. Reservoir 80 includes a lower tapered or conical portion 82 which mates within the truncated conical evaporator cooling plate or pan 64. A baffle 100 fits within reservoir 80, and the baffle and reservoir together are termed here the "reservoir assembly." A cylindrical insulation shell 85 preferably covers the outside of reservoir 80 to limit ambient temperature effects on the reservoir liquid. Insulation shell 85 is preferably made of a sufficiently rigid material suitable for facilitating the positioning of reservoir 80, while having sufficient insulating properties, such as can be found with polystyrene materials like styrofoam. Evaporator cooling plate or pan 64 can be located in the bottom portion of the cavity formed by the walls of insulation shell 85, and is formed of a thermally conductive material. Refrigerant-filled coils or tubes, such as copper tubes, are positioned in communication with cooling pan 64, preferably secured or coiled around lower or side surfaces of cooling pan 64. The bottom surface of reservoir 80 generally corresponds in shape, and rests directly in contact with, the inner surfaces of cooling pan 64, maximizing the surface contact area and heat transfer between those surfaces, as discussed further below. Cooling pan 64 is adapted to be maintained at low temperatures, such as temperatures in the range of 0 to 5 degrees Fahrenheit, under control of a thermostat, thereby serving to chill the water in the lower region of the reservoir.

To accommodate a liquid containment device, such as a bottle or other liquid container 35, housing cover 49 includes opening 52. When reservoir 80 is properly positioned, and housing cover 49 is in place, housing cover opening 52 is aligned or registers with the neck of liquid container 35. This permits liquid in liquid container 35 to flow into and fill reservoir 80. To facilitate the positioning of inverted bottle 35, housing cover 49 can be provided with an inwardly-tapered and radiused collar portion surrounding cover opening 52, and corresponding in shape to the neck of liquid container 35. Of course, many variations of the standard water cooler components well known to those of skill in the art can be utilized in the practice of the present invention. For example, such components as illustrated in U.S. Pat. No. 4,629,096, incorporated herein by reference, may be used.

Figure 21:
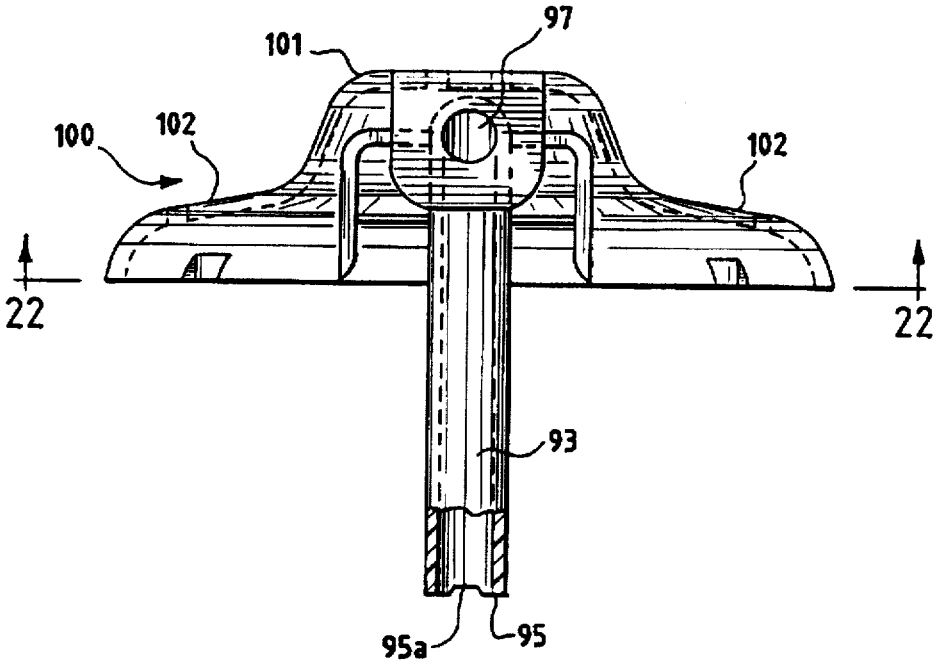
FIGS. 21 and 22 are side and sectional views, respectively, of the baffle of the present invention.

Other structural components of liquid dispenser 30 of the present invention are necessary in its operation, and will now be described in conjunction with a description of that operation. Referring to the "cook and cold" liquid dispenser embodiment shown in FIGS. 3–6, liquid conduits 90*a* and 90*b* are provided in fluid communication with reservoir 80. Liquid conduits 90*a* and 90*b* are preferably integrally constructed with reservoir 80, and terminate in spigots or faucets 51 and 52 (as shown at FIGS. 1–2), which can be threadably fastened to the free ends of conduits 90*a* and 90*b*. To permit the coolest water to be drawn from reservoir 80 (which is, of course, the water located closest to cooling pan 64), a cold water pickup tube 93 is provided with an open end 95 adjacent the bottom surface of reservoir 80. Pickup tube 93 is in fluid communication at its other end with liquid conduit 90b (which leads to "cold" faucet 52). In the preferred embodiment, cold water pickup tube 93 is integrally formed with baffle 100 (described below), and is located directly below cold faucet 52, minimizing cold water travel. Cold water pickup tube 93 is also preferably slightly spaced from the outside surface of reservoir 80 a sufficient distance to prevent the build-up of ice due to the proximity of the cooling coils located on the outside surfaces of cooling pan 64. As shown in FIG. 21, opening 95 of cold water pickup tube 93 includes a notched portion 95a. Notched portion 95a ensures continued liquid flow should opening 95 be forced against bottom surface 81 of the reservoir. Notched portion 95a also serves to help prevent blockage due to ice build-up at opening 95.

With the "cook and cold" embodiment, liquid conduit 90a can be placed in direct fluid communication with the liquid in reservoir 80 above baffle 100. Therefore, when faucet 51 is opened, nearly room temperature liquid will be supplied to "cook" faucet 51. In this embodiment, if hot water conduit 160 leading to water heater 130 (discussed below) is present, it can be closed, rendering it nonfunctional.

In either the "cook and cold" or "hot and cold" embodiments, to prevent the warmer water in the upper region of reservoir 80 from mixing with the cooler water located in the lower region of reservoir 80, a substantially horizontal plate or baffle 100 is preferably located at about the same level as liquid conduits 90a and 90b. Baffle 100 extends in a generally horizontal plane and acts as a temperature buffer to substantially prevent the incoming flow of water in the upper portion of reservoir 80, originating from inverted liquid container 35, from disturbing the temperature gradient existing across baffle 100, and substantially raising the temperature of the cool water below baffle 100.

Referring now to FIGS. 3–10 and 21–22, baffle 100 preferably has smooth surfaces to induce laminar flow, and is provided with a cup-shaped region 101 and a curved lower periphery 102. Three equidistant narrow slots 104 are provided, as shown in FIG. 21. These equidistant slots permit an equal flow of water through the baffle from all sides, while limiting water flow and heat transfer effects between the water levels below and above the baffle. Baffle 100 includes an aperture 110 at its center.

Figure 22:
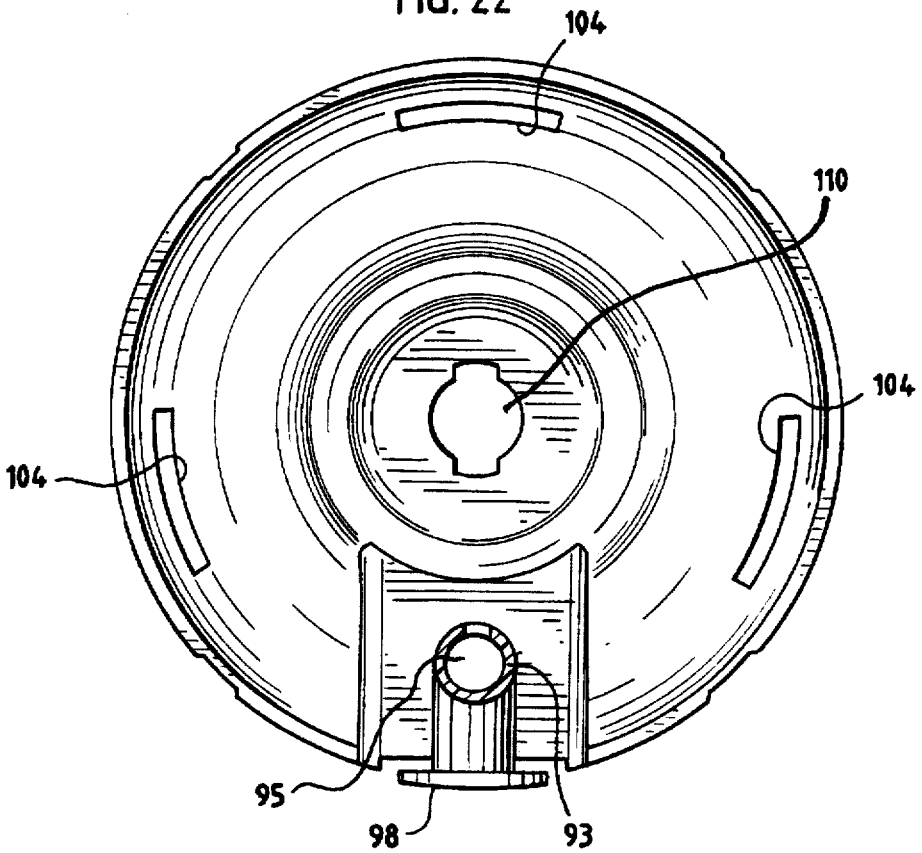

Referring specifically to FIGS. 21 and 22, the top of cold water pickup tube 93 on baffle 100 terminates in an opening 97, which is in fluid communication with a corresponding opening on the interior sidewall of reservoir 80, and in continued fluid communication with liquid conduit 90b. Opening 97 is surrounded by a flange 98 which nests within a corresponding brace 99 shown at FIGS. 7 and 8; this mating interaction serves to properly locate and hold baffle 100 within reservoir 80.

Figure 20:
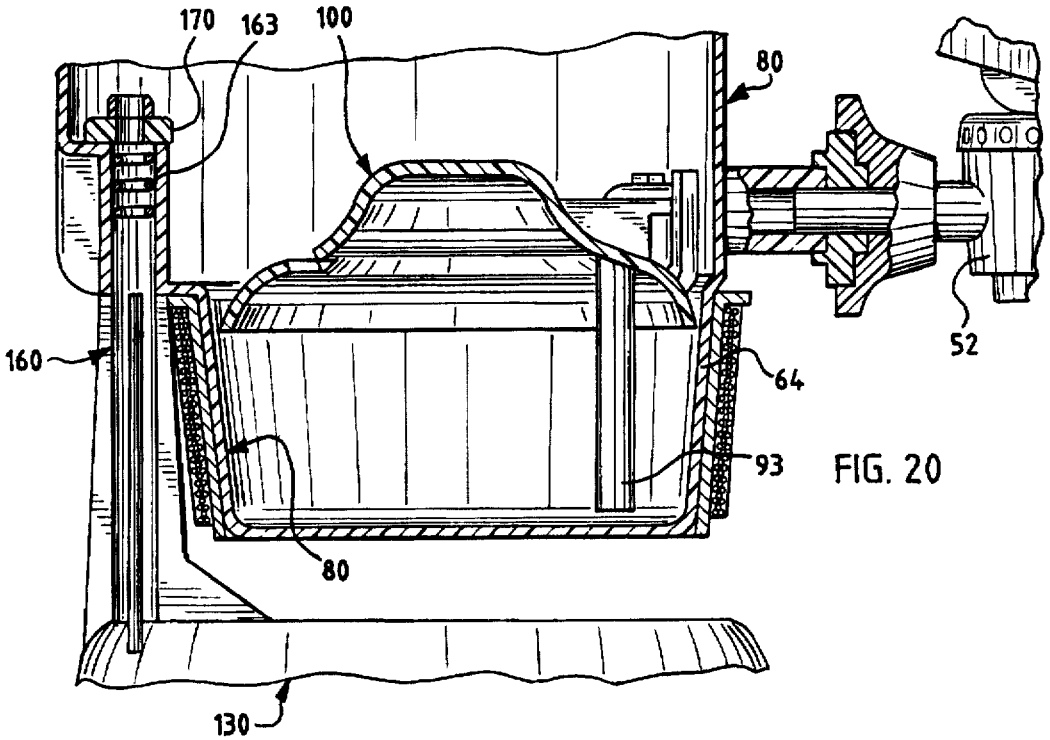
FIG. 20 is a sectional view illustrating an alternative configuration for the lower reservoir portion.

Referring to FIGS. 3–10, and more particularly to the "hot and cold" embodiment shown at FIGS. 7–10, reservoir 80 includes a centrally-located, raised reservoir bottom 84 that can be integrally constructed with reservoir 80. A central location for raised reservoir bottom 84 is preferred, since this placement maximizes the external surface area of the lower portion of reservoir 80, thereby maximizing exposure to the cooling coils and increasing cooling efficiency. Alternatively, as shown in FIG. 20, a side placement of raised reservoir bottom 84 could be employed, with hot water conduit 160 extending upwardly along a side of reservoir 80.

Figure 19:
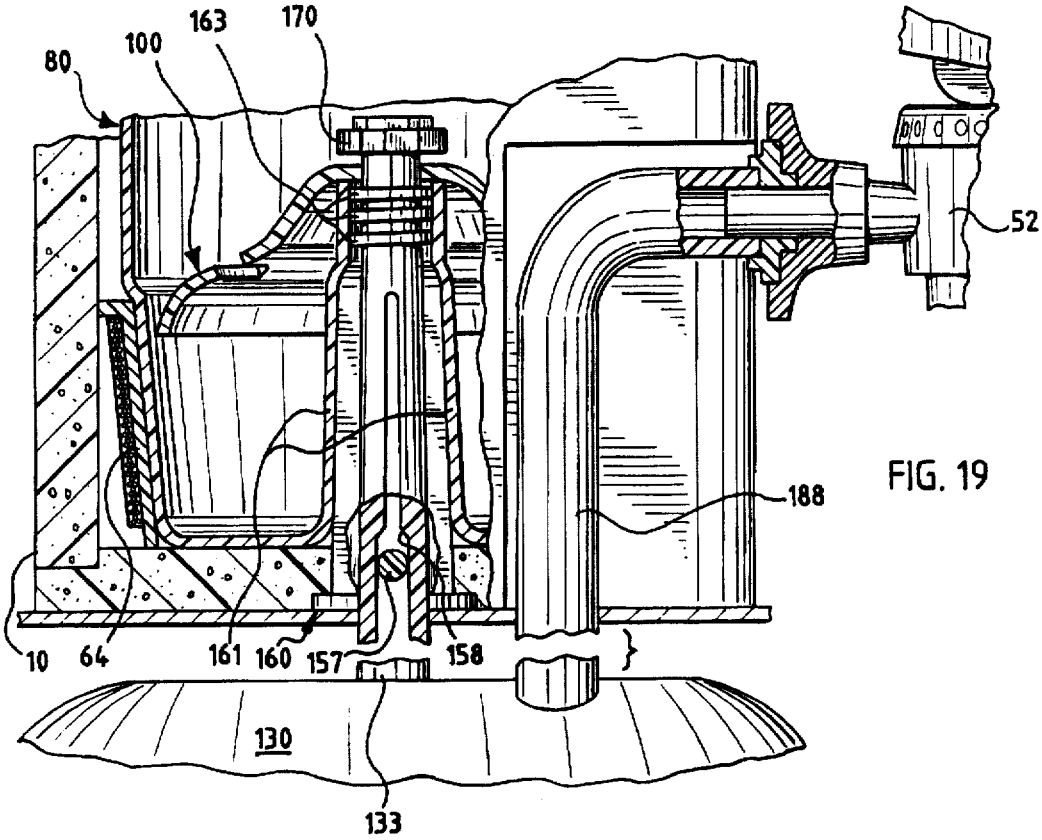
FIG. 19 is a side view, partially in section, illustrating portions of the reservoir assembly and hot tank of the "hot and cold" liquid dispenser embodiment of the present invention.

Raised reservoir bottom terminates at its top in an open, room temperature water discharge port 86. Discharge port 86 is located at least slightly above "hot" faucet 51 (not shown in FIGS. 7–10) and opens on the top surface of baffle 100. Referring to FIG. 2, port 133 of water heater or hot tank 130 is in fluid communication with upwardly extending hot water conduit 160. Hot water hose 188 is in fluid communication with hot water faucet 51. As shown in FIG. 19, raised reservoir bottom 84 of reservoir 80 surrounds the periphery of hot water conduit 160. Raised reservoir bottom 84 preferably has a diameter substantially larger than hot water conduit 160.

Hot water conduit 160 preferably includes raised vertical ribs 161, which serve to facilitate the proper location of reservoir 80. Ribs 161 also function to space hot water conduit 160 and reservoir 80. This spacing minimizes the heat transfer effects of the water cooled by cooling pan 64 on the water from liquid container 35 flowing down through hot water conduit 160 and into hot tank 130. The raised central region 101 accommodates the raised reservoir bottom 84 and hot water conduit 160 which extend vertically above the horizontal plane of conduits 90a and 90b.

Hot water conduit 160 includes structure, such as elastomeric O-rings or washers 163, so that when hot water conduit 160 is brought in a relatively tight, frictional engagement with raised reservoir bottom 84, that engagement will be leak-free, preventing any liquid within reservoir 80 from flowing between the outside surface of hot water conduit 160 and the inside surface of raised reservoir bottom 84. The upper end of hot water conduit 160 preferably terminates with structure, such as a fastener or nut 170, permitting, through finger-tight engagement, the exertion of a downward compressive force on reservoir 80, partially translating also into an outwardly directed radial force on the lower sides 88 of reservoir 80, and ensuring that reservoir 80 will be maintained in contact with cooling pan 64. The cup-shaped portion 101 of baffle 100 is also designed to provide baffle 100 with sufficient central strength to withstand deformation when nut 170 is tightened down.

Referring to FIG. 19, hot water conduit 160 also preferably includes a ball check valve, such as floating polypropylene ball 157, which can be moved against a seat 158. The check valve of hot water conduit 160 acts to substantially prevent the recirculation of hot water from water heater 130 through hot water conduit 160, port 86, back into the upper region of reservoir 80 above baffle 100. This further minimizes unwanted heat transfer effects between the upper and lower regions within the reservoir assembly.

The proper engagement of the lower surface of reservoir 80 with cooling pan 64 will now be discussed. To facilitate disassembly, reservoir 80 must be readily removable from cooling pan 64. Reservoir 80 and tapering conical surfaces 88 should also be sized to fit in close, frictional engagement with the inner side surfaces of cooling pan 64, to maximize cooling efficiency, though not so tightly as to prevent ready disassembly. This can be accomplished by designing the lower region of reservoir 80 with a frusto-conically tapering shape 88, as shown in FIG. 4. As an alternative example, the lower reservoir edges 88 could be tapered with the lower reservoir portion having a rectangular configuration.

Referring again to the preferred embodiment shown within FIGS. 1 and 2, the interconnection between reservoir 80, alcove housing 60, external housing 40 and the liquid dispensing means (including liquid conduits 90a and 90b, and faucets 51 and 52) will now be described. With the external housing 40 assembled, an escutcheon plate or alcove adaptor 200 can be assembled to reservoir 80, and serves to locate and secure the reservoir assembly within the external housing by engaging the periphery of a cut-out or opening formed below top front wall 42. In addition to facilitating the use of the present invention with dispensers of different manufacturers, as discussed below, alcove adaptor 200 also serves the aesthetic function of improving the overall appearance of the liquid dispenser. Finally, alcove adaptor 200 also limits the entry of moisture-laden air from the surrounding atmosphere to the region adjacent cooling pan 64, to limit condensation produced on pan 64.

Referring to FIG. 2, alcove adaptor 200 can be assembled to the reservoir assembly through the use of struts 202 on alcove adaptor 200, which pass through openings within alcove insulation 87 (which mates with the shell 85), and connect to locating posts 83*a* and 83*b* on reservoir 80.

In the "cook and cold" embodiment shown, for example, in FIG. 3, the ends of liquid conduits 90*a* and 90*b* would pass through the alcove openings 206 and 205, respectively, shown in FIG. 2. Faucets 51 and 52, now properly positioned within alcove openings 206 and 205, respectively, are then passed through alcove opening 61 of alcove housing 60. Alcove adaptor 200 is positioned by disposing its side edges within slots 240 on the rear of alcove housing 60 (shown in FIGS. 11–18, and described below). With the "hot and cold" embodiment, alcove opening 206 is preferably open on its bottom edge, since "hot" faucet 51 is permanently attached to hose 188 of hot tank 130, and this facilitates connection with faucet 51. An alcove adaptor locator 210 can then be fitted within alcove opening 206 to properly position hot faucet 51.

With a "hot and cold" embodiment, the reservoir 80 may be removed with cold faucet 52 remaining assembled to the reservoir, while hot faucet 51 remains permanently assembled to the housing. Alternatively, with a "cook and cold" embodiment, the reservoir and both faucets are removable without any disassembly. This permits easy cleaning of the preferably all-plastic reservoir assembly.

Unlike known prior art liquid dispenser apparatus, the components of various housing assemblies, when used with the adaptors disclosed here, can be used with reservoir and liquid dispenser assemblies manufactured by others. For example, and turning now to FIGS. 11–14, an alcove adaptor for use with a housing manufactured by Sunroc and designated generally as 220 is illustrated. The Sunroc alcove adaptor 220 differs in height from alcove adaptor 200, and openings 223 and 225 are spaced from each other a different distance than openings 205 and 206 of alcove adaptor 200. Ledge 227 of the Sunroc adaptor differs in length from ledge 203 of alcove adaptor 200, and includes an upwardly extending lip 229.

The structural features of the Sunroc adaptor 220 facilitate the connection of the external housing components of the present invention to a dispenser manufactured by Sunroc. As shown at FIG. 14, the Sunroc alcove adaptor 220 is positioned over alcove opening 60 and slots 240.

Turning now to FIGS. 15–18, another alcove adaptor 240 is illustrated. This adaptor allows the housing of the present invention to be assembled with an Ebco dispenser. The alcove adaptor 200 again differs in height and hole spacing from the other two alcove adaptors 200 and 220 already described, and functions in a similar manner to that described with reference to those adaptors.

The reservoir assembly may be formed from any suitable nontoxic and noncorrosive material. Preferably, it is formed from plastic materials, such as polypropylene, which provide structural strength and rigidity while resisting fracturing. Such materials are preferably easily cleaned and resistant to algae formation or the adhesion of other biological substances that can form in water remaining relatively stagnant for a period of time.

In an alternative embodiment, the liquid container or source, rather than an inverted bottle or carboy, could be a continuous, piped liquid supply, or other liquid container or source.

In still other alternative embodiments, the liquid valve dispensing means can consist of structures other than faucets, and need not be located in a side-by-side spaced relationship, or need not even be located on the same housing wall portion.

In yet another alternative embodiment, the present invention may include at least a second liquid reservoir provided with its own liquid valve means similar to those described above. An electrical heating element and thermostat may be provided, located preferably externally to and adjacent or in contact with one of the reservoirs. Suitable insulation material may be provided between the first reservoir, which can be cooled, and the second reservoir, which can be heated.

In still another alternative embodiment, alternative designs from the alcove housing and configuring alcove adaptors (the "alcove assembly") shown here can be provided, for connection to various external housings of different manufacturers. These alternative designs may include a configurable upper housing, for example, rather than the selection of a particular alcove adaptor for use with a particular external housing.

Of course, it should be understood that various changes and modifications to the preferred embodiments described herein will be apparent to those skilled in the art. For example, an alcove housing need not even be used, as long as some structure is provided to ensure the proper location and position of the liquid conduits tubes from the reservoir assembly, and their connection to the faucets. Other changes and modifications, such as those expressed here or others left unexpressed but apparent to those of ordinary skill in the art, can be made without departing from the spirit and scope of the present invention and without diminishing its attendant advantages. It is, therefore, intended that such changes and modifications be covered by the following claims.

We claim:

1. An apparatus for dispensing liquid from a liquid container, comprising:

a housing assembly supporting the liquid container, the housing assembly including a generally vertical wall with a recessed portion forming an alcove, the alcove having an opening;

a reservoir containing the liquid located within the housing assembly and in fluid communication with the liquid container and with one or more liquid dispensing elements, the reservoir including a bottom surface and a raised bottom portion terminating in a port, wherein the reservoir, upon removal of the liquid container, is vertically removable from the housing assembly, and adapted to be readily dropped into or lifted out of the housing assembly;

the one or more liquid dispensing elements being positioned outside the reservoir and located to project into the alcove opening, the one or more liquid dispensing elements thereby being accessible to a user of the dispensing apparatus;

a baffle located within the reservoir and separating the reservoir into lower and upper regions containing the liquid, the baffle serving to minimize heat transfer between the liquid within the lower region and the warmer liquid within the upper region;

a cooling element operable to cool the liquid within the lower region of the reservoir, the bottom surface of the reservoir resting on and being in heat exchange relation with the cooling element; and the port on the raised bottom portion of the reservoir being positioned above both the baffle and the one or more liquid dispensing elements.

2. The liquid dispenser of claim 1, wherein the cooling element includes a cylindrical pan having a curved inner surface, and the periphery of the lower region of the reservoir forms a conically tapered portion operative for mating, frictional engagement with the curved inner surface of the cylindrical pan.

3. The liquid dispenser of claim 1, further comprising a heater located below the reservoir, and a downwardly extending conduit in fluid communication between the heater and the upper region of the reservoir, the heater operative to heat liquid received from the downwardly extending conduit, the raised bottom portion of the reservoir surrounding and being in liquid-tight engagement with at least a portion of the downwardly extending conduit.

4. The liquid dispenser of claim 3, wherein the downwardly extending conduit includes a check valve serving to minimize the recirculation of heated liquid flowing from the heater and back into the upper region of the reservoir.

5. The liquid dispenser of claim 3, wherein the downwardly extending conduit includes at least one spacer located on its periphery and engaging the raised bottom portion of the reservoir, the at least one spacer facilitating the proper positioning of the reservoir, and also serving to separate the liquid within the lower region of the reservoir from the liquid flowing through the downwardly extending conduit, thereby minimizing heat transfer effects between the liquids.

6. An apparatus for dispensing liquid from a liquid container, comprising:

a housing assembly supporting the liquid container;

a reservoir operably connected to the housing assembly and in fluid communication with the liquid container and with at least two liquid dispensing elements, the reservoir including a bottom surface and a raised bottom portion terminating in a port, wherein the reservoir, upon removal of the liquid container, is readily removable from the housing assembly;

a baffle located within the reservoir and separating the reservoir into lower and upper regions containing the liquid, the baffle serving to minimize heat transfer between the liquid within the lower region and the warmer liquid within the upper region;

the port of the raised bottom surface of the reservoir being in fluid communication with the liquid inside the reservoir that is located above the baffle;

a cooling element operable to cool the liquid within the lower region of the reservoir, the bottom surface of the reservoir resting on and being in heat exchange relation with the cooling element; and an apparatus for heating the liquid supplied to at least one of the at least two liquid dispensing elements, the heating apparatus being in fluid communication with the port.

7. An apparatus for dispensing hot and cold liquids from a liquid container, comprising:

a housing assembly supporting the liquid container;

a reservoir supported by the housing assembly and in fluid communication with the liquid container and with at least first and second liquid dispensing elements, the reservoir including a bottom surface and a raised bottom portion terminating in a port;

a baffle located within the reservoir and separating the reservoir into lower and upper regions containing the liquid, the baffle serving to minimize heat transfer between the lower and upper liquid regions;

the port of the raised bottom surface of the reservoir being in fluid communication with the liquid in the upper region of the reservoir above the baffle;

a cooling element operable to cool the liquid within the lower region of the reservoir below the baffle, the bottom surface of the reservoir resting on and being in heat exchange relation with the cooling element, the liquid within the lower region of the reservoir being in fluid communication with the first liquid dispensing element, the first liquid dispensing element thereby providing the dispensing of cooled liquid;

an apparatus for heating liquid supplied from the upper region of the reservoir, the heated liquid being supplied to the second liquid dispensing element;

the raised bottom portion of the reservoir including a conduit in fluid communication between the heating apparatus and the second liquid dispensing element, permitting liquid to flow from the upper region of the reservoir to the heating apparatus; and the conduit being readily disengageable from the second liquid dispensing element whereby the reservoir, upon removal of the liquid container, is readily removable from the housing assembly.

8. An apparatus for dispensing liquid from a liquid container, comprising:

a housing assembly supporting the liquid container;

a reservoir operably connected to the housing assembly and in fluid communication with the liquid container and with at least one liquid dispensing element, the reservoir including a bottom surface and a raised bottom portion terminating in a port, wherein the reservoir, upon removal of the liquid container, is readily removable from the housing assembly;

a baffle located within the reservoir and separating the reservoir into lower and upper regions containing the liquid, the baffle serving to minimize heat transfer between the liquid within the lower region and the liquid within the upper region;

a cooling element operable to cool the liquid within the lower region of the reservoir;

an apparatus for heating the liquid supplied from the upper region of the reservoir and supplied to the at least one liquid dispensing element; and a hot liquid conduit passing through the interior of the raised bottom portion of the reservoir, the hot liquid conduit being in fluid communication with the port and the heating apparatus, and permitting liquid to flow from the upper region of the reservoir to the heating apparatus.

9. The liquid dispenser of claim 8, wherein the hot liquid conduit includes a plurality of spacers positioned about its periphery.

10. The liquid dispenser of claim 8, wherein the raised bottom portion of the reservoir has a cross-sectional area that is substantially larger than the cross-sectional area of the hot liquid conduit.

11. An apparatus for dispensing liquid from a liquid container, comprising:

a housing assembly supporting the liquid container;

a reservoir operably connected to the housing assembly and in fluid communication with the liquid container and with at least one liquid dispensing element, the reservoir including a bottom surface and a raised bottom portion terminating in a port, wherein the reservoir, upon removal of the liquid container, is readily removable from the housing assembly;

a baffle located within the reservoir and separating the reservoir into lower and upper regions containing the liquid, the baffle serving to minimize heat transfer between the liquid within the lower region and the liquid within the upper region; and a cooling element operable to cool the liquid within the lower region of the reservoir;

wherein the bottom surface of the reservoir is tapering and frusto-conical, and is in close frictional, though disassembled, engagement with portions of the cooling element.

* * * * *